US006198033B1

(12) United States Patent
Lovelett

(10) Patent No.: US 6,198,033 B1
(45) Date of Patent: Mar. 6, 2001

(54) VARIABLE PITCH PERCUSSION INSTRUMENTS

(76) Inventor: Ken S. Lovelett, P.O. Box 65, Mt. Tremper, NY (US) 12457

( * ) Notice: Subject to any disclaimer, the term of this patent is extended or adjusted under 35 U.S.C. 154(b) by 0 days.

(21) Appl. No.: 08/968,541

(22) Filed: Nov. 12, 1997

Related U.S. Application Data

(63) Continuation-in-part of application No. 08/662,916, filed on Jun. 13, 1996, now abandoned.

(51) Int. Cl.[7] ..... G10D 13/02
(52) U.S. Cl. ..... 84/411 R; 84/420
(58) Field of Search ..... 84/411 R, 418, 84/419, 420

(56) References Cited

U.S. PATENT DOCUMENTS 627,766 * 6/1899 Wilken ..... 84/414
2,858,724 * 11/1958 Troppe ..... 84/411 R
4,577,541 * 3/1986 Edge ..... 84/411 R
4,790,228 * 12/1988 Thirion ..... 84/411 R
5,377,575 * 1/1995 Huth, III ..... 84/402

FOREIGN PATENT DOCUMENTS

432206 * 3/1967 (CH) .

* cited by examiner

*Primary Examiner*—Robert E. Nappi
*Assistant Examiner*—Shih-yung Hsieh
(74) *Attorney, Agent, or Firm*—John G. Costa

(57) ABSTRACT

A variable pitch musical drum comprising at least one drumhead the pitch of which can be varied while the drum is being played by varying the volume of air inside the drum, by varying the rate of air flow into or out of the drum, or by a combination of these two principles.

8 Claims, 15 Drawing Sheets

VARIABLE PITCH PERCUSSION INSTRUMENTS

This is a continuation-in-part of U.S. patent application 08/662,916 which was filed on Jun. 13, 1996, now abandoned.

FIELD OF THE INVENTION

This invention relates to variable pitch percussion instruments, particularly, to musical drums and, more particularly, to drums in which the pitch is varied while the drum is being played. By varying the volume of air inside the drum, by varying the rate of air flow into or out of the drum, or by a combination of these two principles the percussionist can change the pitch of the drum as he or she is playing the drum.

BACKGROUND OF THE INVENTION

Conventional musical drums with one playing means are often cylindrical with the playing means, typically a drumhead, on the top surface of the drum and an open air portal on the bottom surface of the drum.

In conventional drums with two playing means, one playing means is on the top surface of the drum, a second playing means is on the bottom surface of the drum and a small air portal is disposed on the cylindrical surface of the drum.

Attempts to vary the pitch of these drums while they are being played generally has involved the use of means to vary the tension on one of the playing means or heads of the drum. A more conventional way of providing drums with different pitch has been the use of drum sets in which each drum of the set is of a different size or the heads have different tensions applied to them. Caribbean steel drums are constructed such that each of several areas of the surface yields a different tone when struck. However, in the Caribbean steel drum, the pitch obtained by striking a given area cannot be varied.

In most conventional drums the air portals function passively and are not played by the percussionist. Hence, in those conventional drums the air portals are not playing means. There are drums, such as the ghatam from India, in which the player can vary the pitch by partially occluding an air portal while striking a rigid drum shell.

Prior to playing a drum, percussionist often stretch or loosen the drum heads to tune the drum to a desired pitch. Sapp, in U.S. Pat. No. 635,192, introduced an expansile head-tensioning tube to uniformly stretch a drum head around its circumference. Although the means employed by Sapp permits one to variably tune a drum prior to playing the drum, Sapp's invention does not permit the pitch to be varied as the drum is being played.

This invention introduces means of changing the pitch of a drum, while the drumhead is being played, by varying the volume of air inside the drum, by varying the rate of air flow into or out of the drum or by a combination of these two principles. Additional variation in pitch is obtained by providing multiple playing means on an individual drum.

SUMMARY OF THE INVENTION

This invention relates to drums with at least two playing means. Each drum of this invention comprises at least one drumhead. Furthermore, each drum of this invention comprises at least one playing means which when played during the playing of said drum changes the pitch of said drum.

For purposes of this invention, a playing means is a drumhead, an air portal accessible for playing by the percussionist, or an internal air displacing means. For purposes of this invention, an internal air displacing means is a piston, a balloon, a forced air entry means, or any other means used to vary the amount of air inside the drum or to vary the flow of air between the inside and outside of the drum while the drum is being played. For purposes of this invention, a rigid drum surface is not a playing means. For purposes of this invention, the inside of a drum is the volume that would be confined by all of the surfaces of the drum if covers are stretched taut over any air portal. It is to be noted that a drumhead, when it is struck, displaces air inside the drum. It is also noted that a drum is played by striking a drumhead. It is further noted that by varying the area of an air portal, or by partially covering an air portal as the drumhead is struck, the flow of air between the inside and outside of the drum is altered.

The drum comprises at least two playing means, one being a drumhead and another being either an air portal or an internal air displacing means. Each subsequent playing means, from the third to the last, if any, may be a drumhead, an air portal or an internal air displacing means. The drum may include any additional number of playing means. Preferably, each air portal is disposed either on a drum surface comprising another playing means or on a drum surface adjacent to a drum surface comprising another playing means.

OBJECTS OF THE INVENTION

It is an object of the invention to provide a drum the pitch of which is varied by the player while the drum is being played.

It is another object of the invention to provide means for varying the pitch of the drum, wherein said means are readily accessible to a player while the player is playing the drum.

Other objectives will become obvious with the reading of the description and claims of the invention.

DETAILED DESCRIPTION OF THE INVENTION

Figure 1:
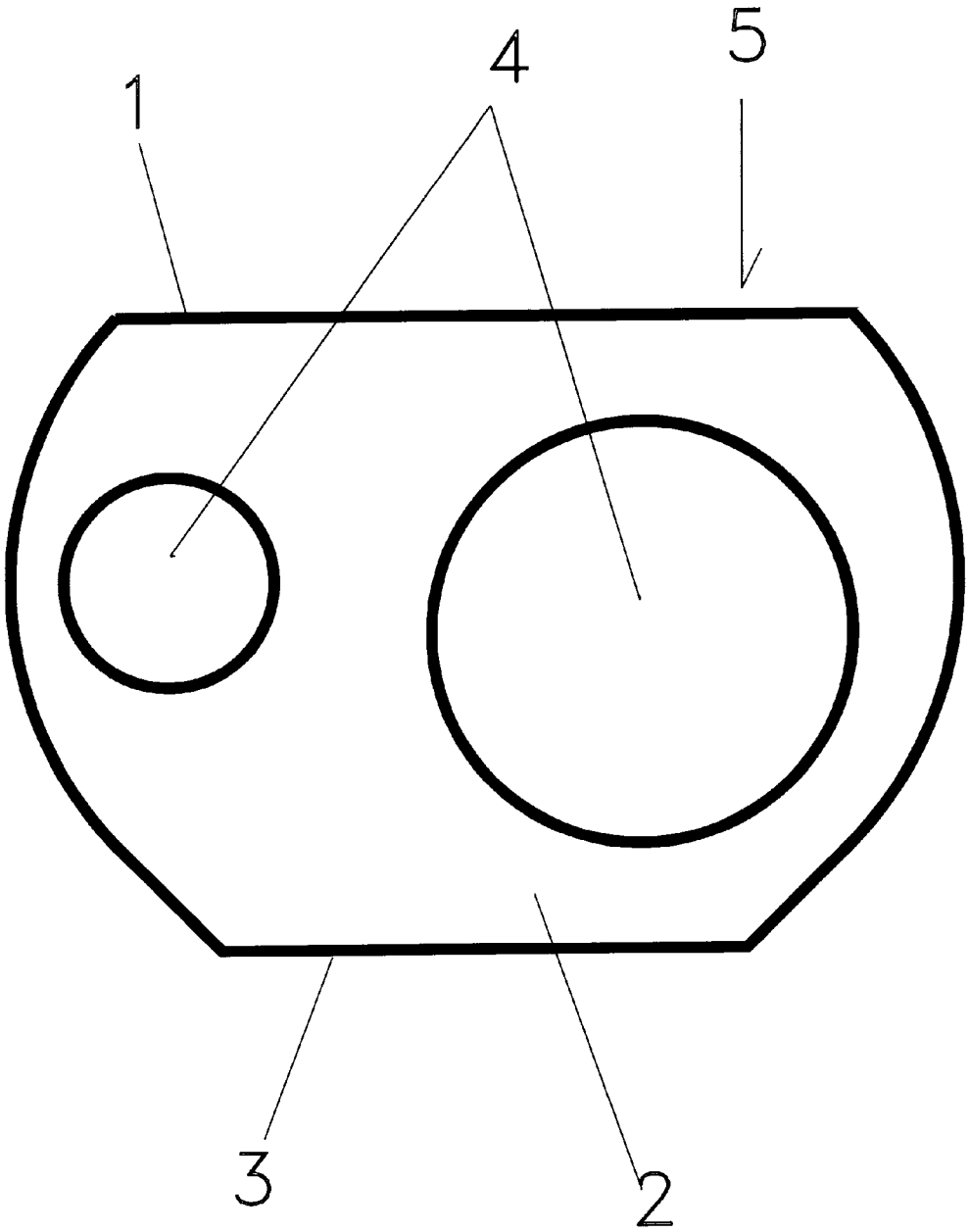
FIG. 1 is a plan view of one surface of an embodiment of the invention.

In a preferred embodiment, a variable pitch musical drum comprises a first drum surface, at least one first drum surface drumhead disposed on said first drum surface, and at least one first drum surface air portal disposed on said first drum surface, wherein varying the aperture of at least one said first drum surface air portal during the playing of said drum changes the pitch of said drum.

In another preferred embodiment, a variable pitch musical drum comprises a first drum surface, at least one first drum surface drumhead disposed on said first drum surface, a second drum surface, and at least one second drum surface air portal disposed on said second drum surface, wherein varying the aperture of at least one said second drum surface air portal during the playing of said drum changes the pitch of said drum. A drum of this preferred embodiment may further comprise at least one second drum surface drumhead disposed on said second drum surface or at least one first drum surface air portal disposed on said first drum surface, wherein varying the aperture of at least one said first drum surface air portal during the playing of said drum changes the pitch of said drum.

In another preferred embodiment, a variable pitch musical drum comprises a first drum surface, at least one first drum surface drumhead disposed on said first drum surface, and an internal air displacing means, wherein the playing of said internal air displacing means during the playing of said drum changes the pitch of said drum. In this embodiment said internal air displacing means preferably comprises a tube and means of introducing air into the inside of said drum through said tube, or a balloon attached to a tube and means of introducing air through said tube into said balloon or a piston.

Any of the drums of the preferred embodiments may further comprise additional percussion means such as, for example, blocks, cymbals, bells, chimes, triangles, rattles, surface indentations and surface ridges.

A further additional percussion means, available when the shape of the drum permits, is an integrated shaker.

Examples of the invention will be described in detail by referring to the figures.

Referring to the figures, drums 5, 6, 11, 14 and 15 are illustrated. For consistency in explanation, drum surfaces 1 and 2 are adjacent to each other and drum surface 3 is not adjacent to drum surface 1. Each playing means 4 is either an air portal or a drumhead.

Figure 2:
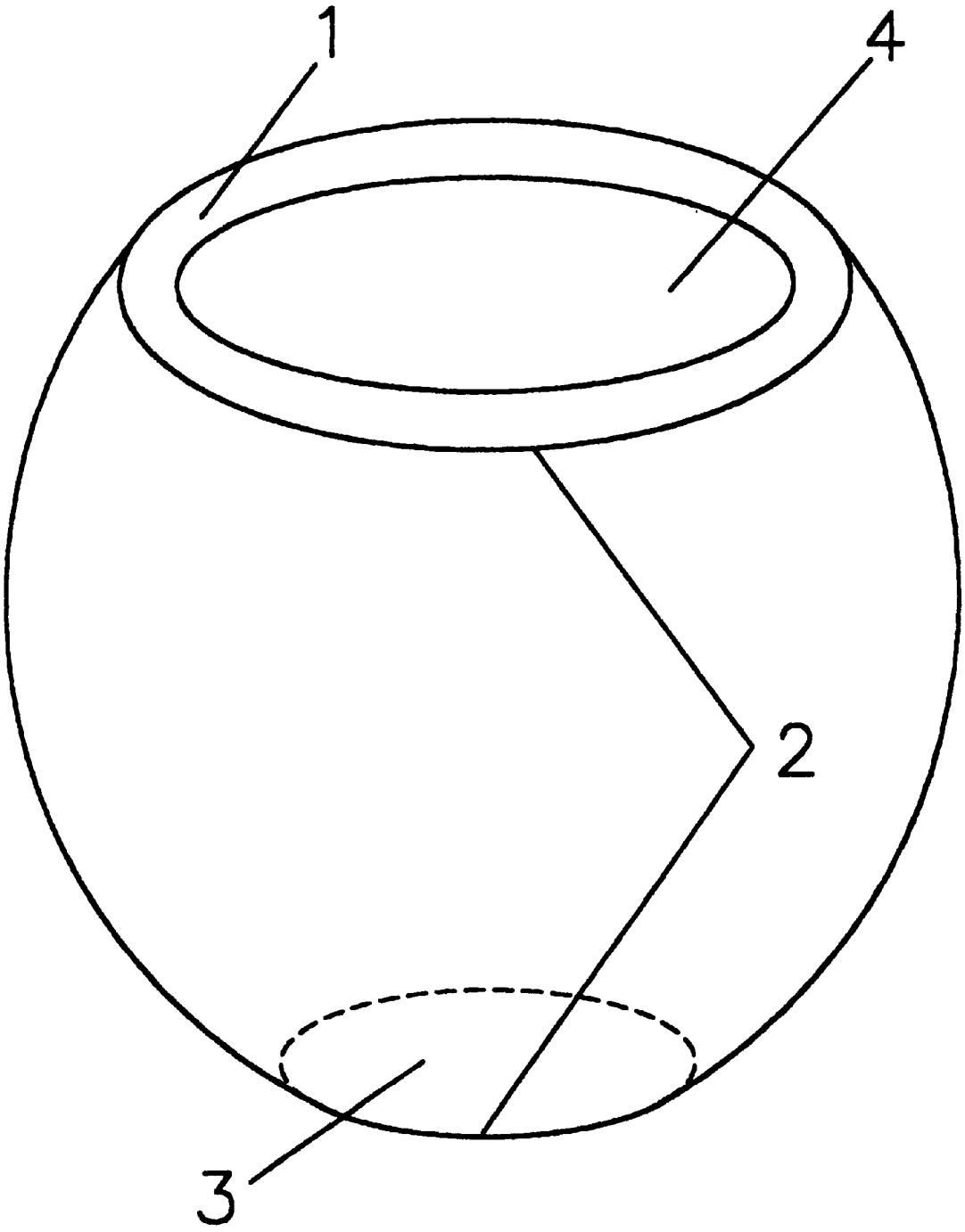
FIG. 2 shows plan views of two surfaces of the embodiment depicted in FIG. 1.

FIGS. 1 and 2 show the drum 5, with drum surfaces 1, 2, and 3 and playing means 4. At least one playing means 4 is a drumhead and at least one playing means 4 is an air portal. Preferably two of said playing means 4 are drumheads and one is an air portal. Surface 1 comprises one playing means 4. Drum surface 2 is circumferentially connected to surfaces 1 and 3. Drum surface 2 comprises two playing means 4. The playing means can be positioned to the liking of the performer. Drum surface 3 is closed.

In a preferred embodiment, in the drum 5, the playing means 4 on drum surface 1 and one of the playing means 4 on drum surface 2 are drumheads and the other playing surface 4 on drum surface 2 is an air portal. In this preferred embodiment, drum surfaces 1 and 2 are at right angles to each other. This configuration allows the player to alternately and rapidly play the two drumheads with one hand and to vary the pitch of the drum by varying the occlusion of the air portal with the other hand.

Figure 3:
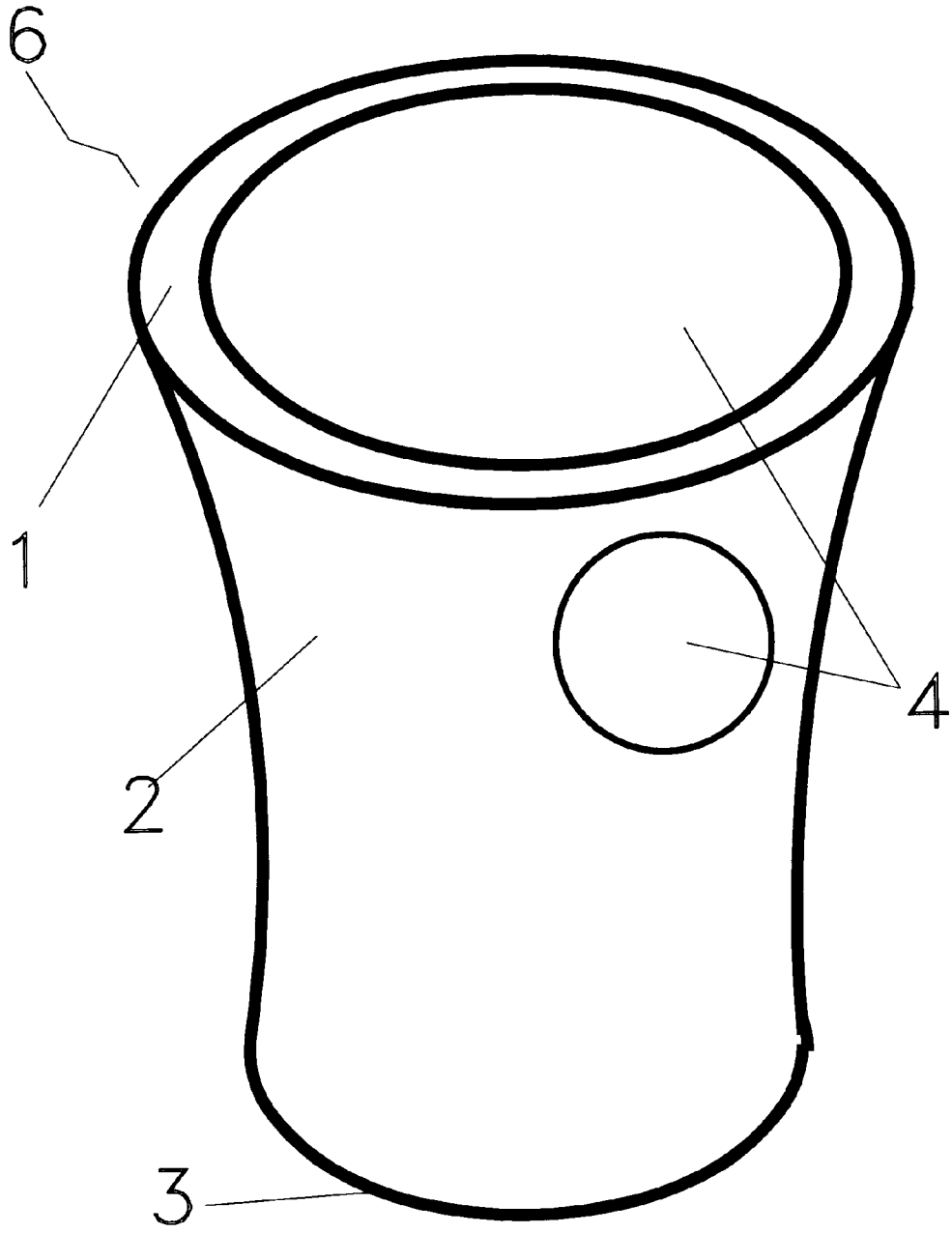
FIG. 3 is a perspective view of an embodiment of the invention.

FIG. 3, shows another embodiment wherein the drum 6, with surfaces 1, 2 and 3, is more nearly cylindrical. Drum surfaces 1 and 2 comprise playing means 4. In a preferred embodiment, in drum 6, as represented in FIG. 3, the playing means 4 on surface 1 is a drumhead, and the playing means 4 on surface 2 is an air portal, and surface 3 is closed.

Figure 4:
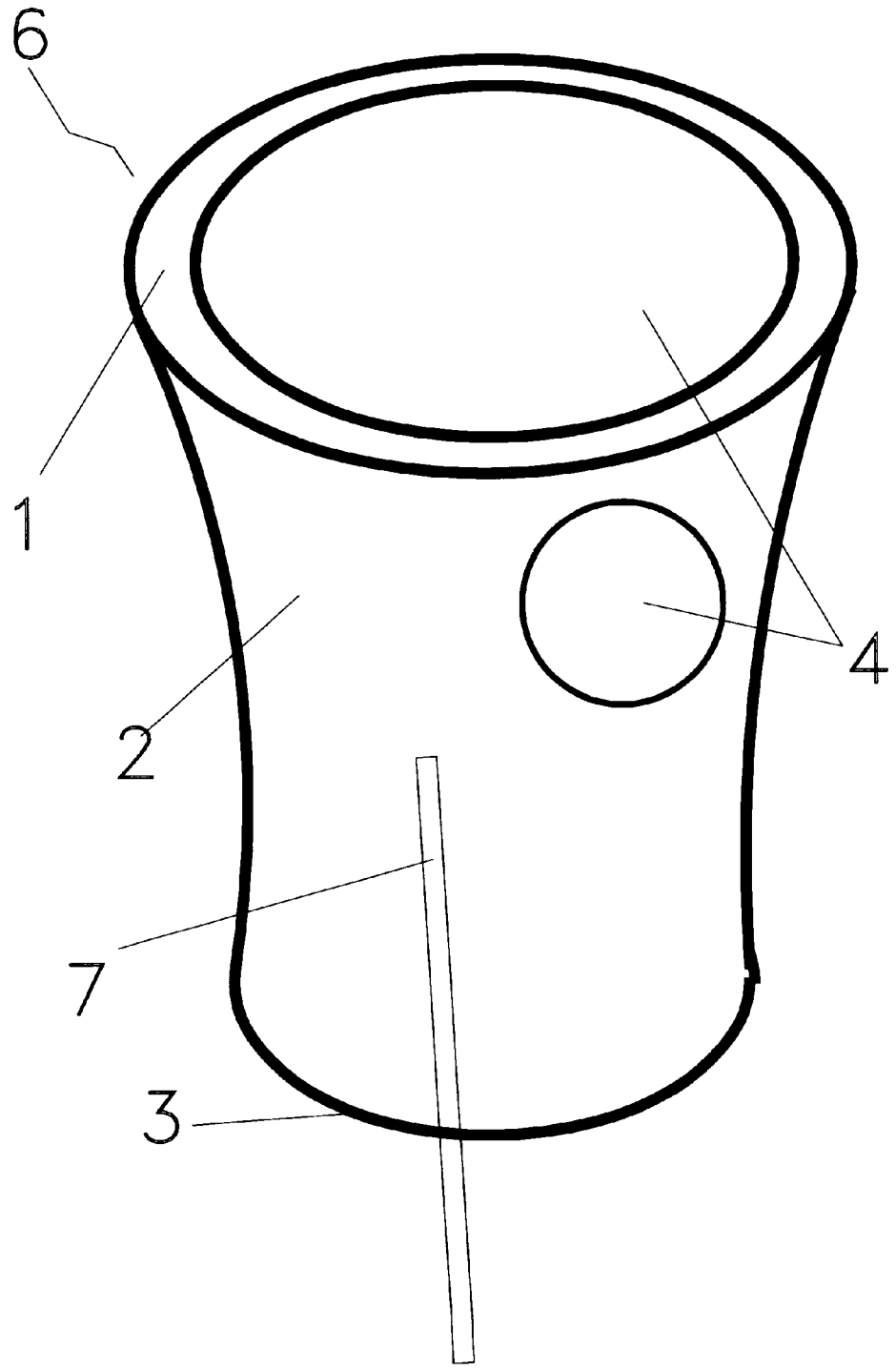
FIG. 4 is a schematic of an embodiment of the invention.

FIG. 4, shows another embodiment wherein the drum 6, of FIG. 3, also comprises a tube 7. The tube 7 is a tube disposed inside the drum and extending outside the drum. In the preferred embodiment, in drum 6, as represented in FIG. 4, the external end of tube 7 is attached to a bellows or other means of introducing air into the drum. Typically, the bellows is controlled by the player's foot. The playing means 4 on surfaces 1 and 2 are drumheads. As air is introduced into or released from the drum the pitch of the drumheads varies.

The earliest versions of the drum in FIG. 4 used a check valve to prevent air from escaping back through tube 7 and a small air portal in the cylindrical side of the drum to permit air to escape through that portal. However, the range of pitch variation and overall performance has been found to be enhanced when the check valve was removed and the portal closed.

Figure 5:
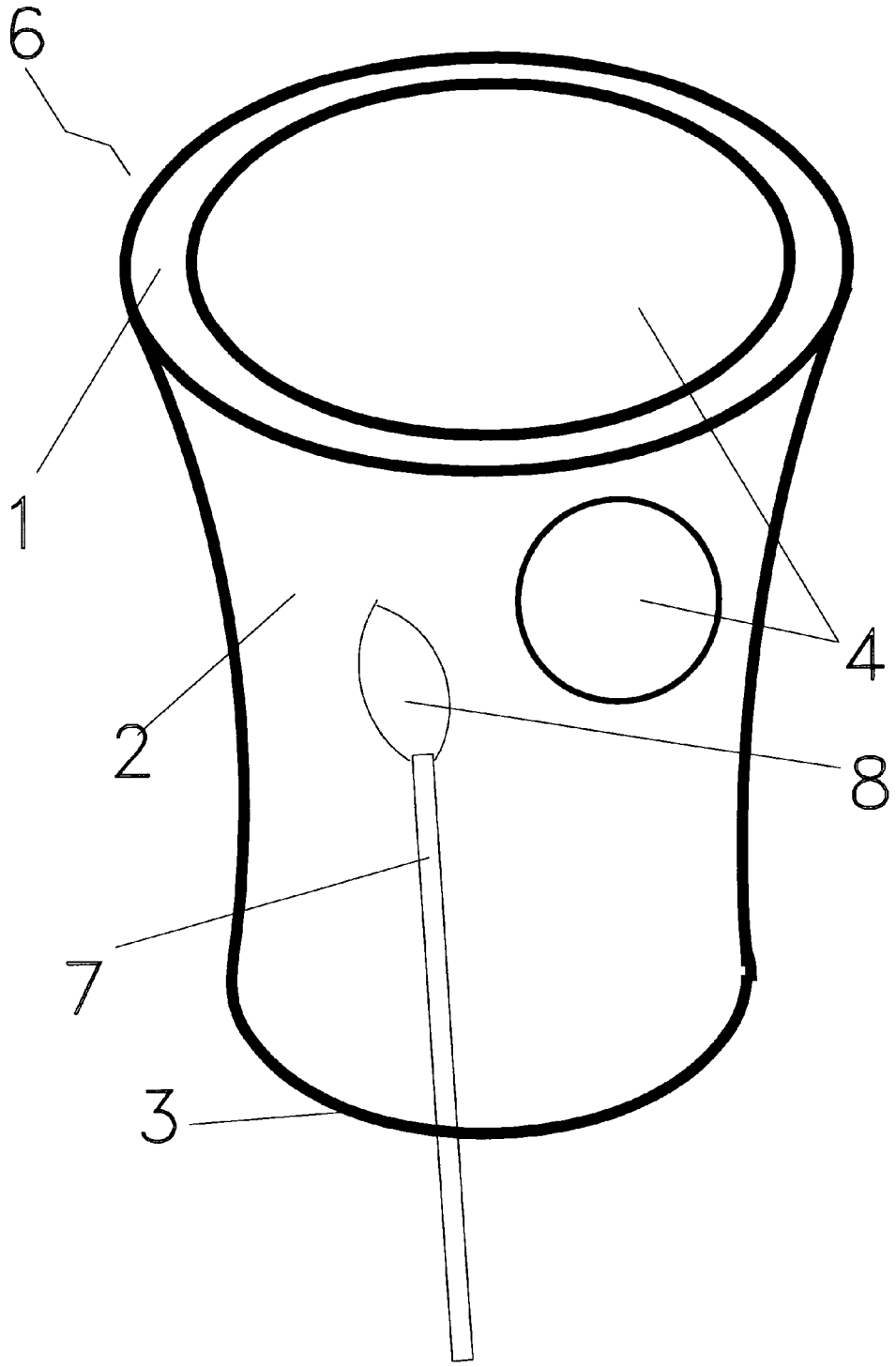
FIG. 5 is a schematic of an embodiment of the invention.

FIG. 5, shows another embodiment wherein the drum 6, of FIG. 4, also comprises a balloon 8. The balloon 8 is attached to the end of the tube 7 which is disposed inside the drum and the other end of the tube 7 extends outside the drum. In the preferred embodiment, in drum 6, as represented in FIG. 5, the external end of tube 7 is attached to a bellows or other means of introducing air into the balloon, and the playing means 4 on surfaces 1 and 2 are drumheads. The inflation and deflation of the balloon varies the pitch of the drumheads as the drum is being played.

Figure 6:
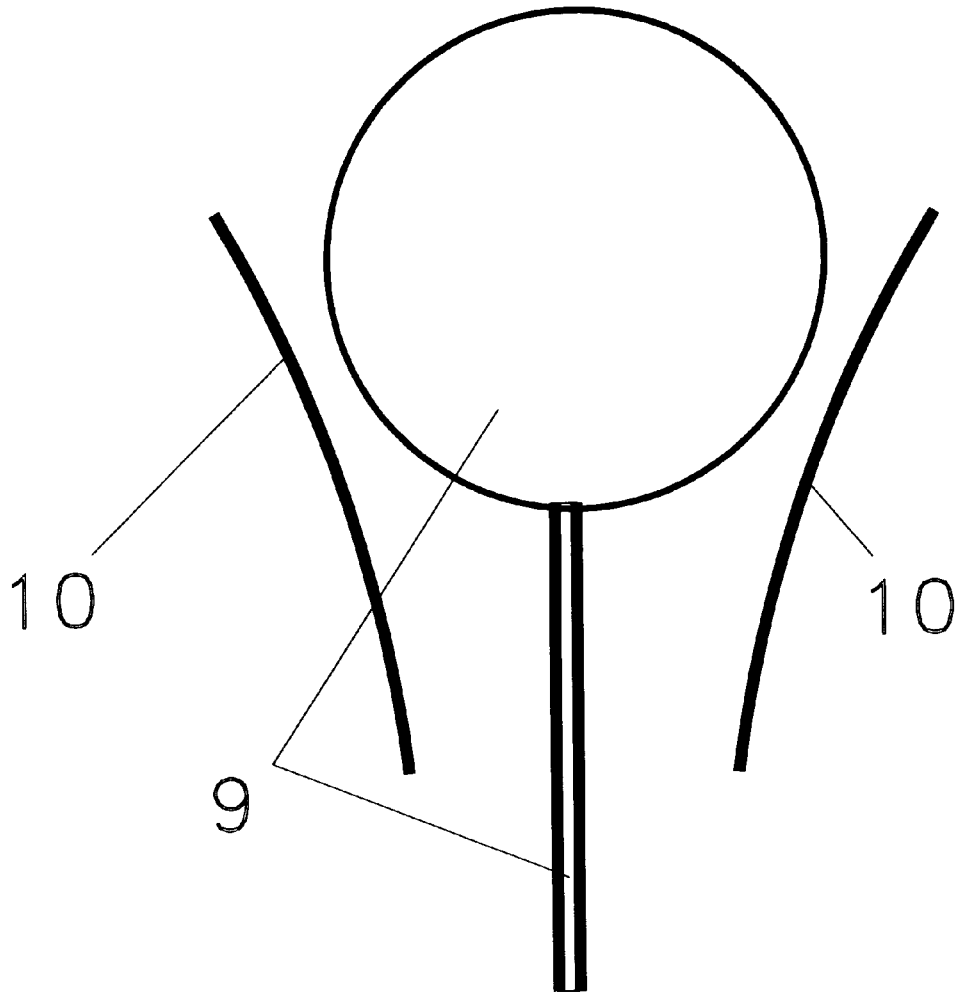
FIG. 6 is a schematic of a pitch varying means in a raised position.
Figure 7:
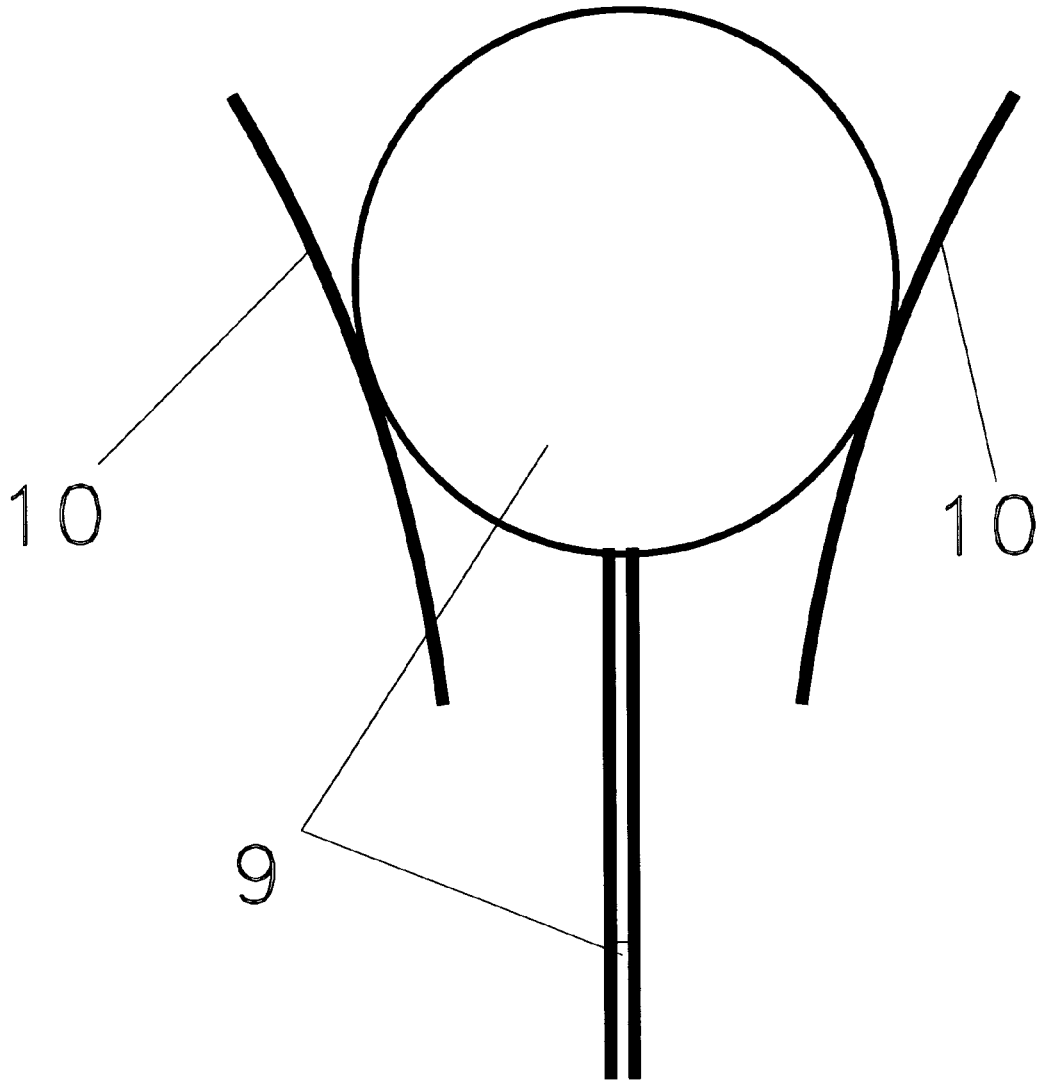
FIG. 7 is a schematic of the pitch varying means of FIG. 6 in a lowered position.

FIGS. 6 and 7 illustrate a piston 9 and part of a drum shell. In FIG. 6 the piston is in its raised position and in FIG. 7 the piston is in its lowered position. In a preferred embodiment, a piston, instead of a balloon, is inserted into a drum such as drum 6 in FIG. 5. If two drumheads are used, as the piston is raised and lowered the pitch of the drumheads varies. In the alternative, if a drumhead is placed on surface 1 and an air portal is placed on surface 2, the player can synchronize the degree of occlusion of the air portal with the position of the piston to vary the pitch of the drumhead.

Figure 8:
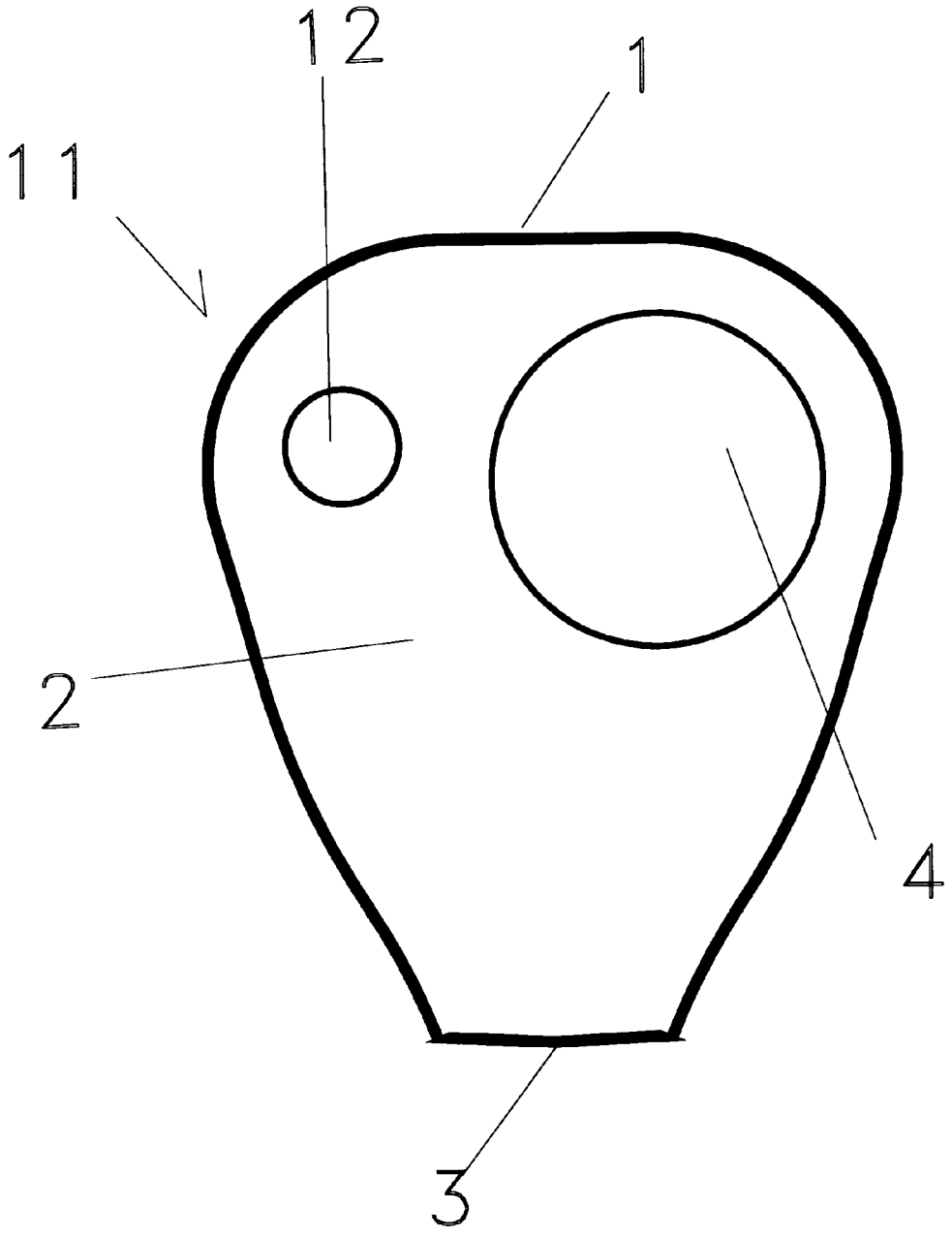
FIG. 8 is a plan view of one surface of an embodiment of the invention.

FIG. 8 shows another embodiment of a drum of this invention. Drum 11 contains a thumbhole 12. In the preferred embodiment, surface 1 comprises one or more air portals and the playing means 4 on drum surface 2 is a drumhead. The player places his thumb through the thumbhole and the fingers of the same hand over the air portal or portals on surface 1. By varying the degree of occlusion of the air portal or portals while playing the drumhead with the other hand, the pitch of the drum is varied.

Figure 9:
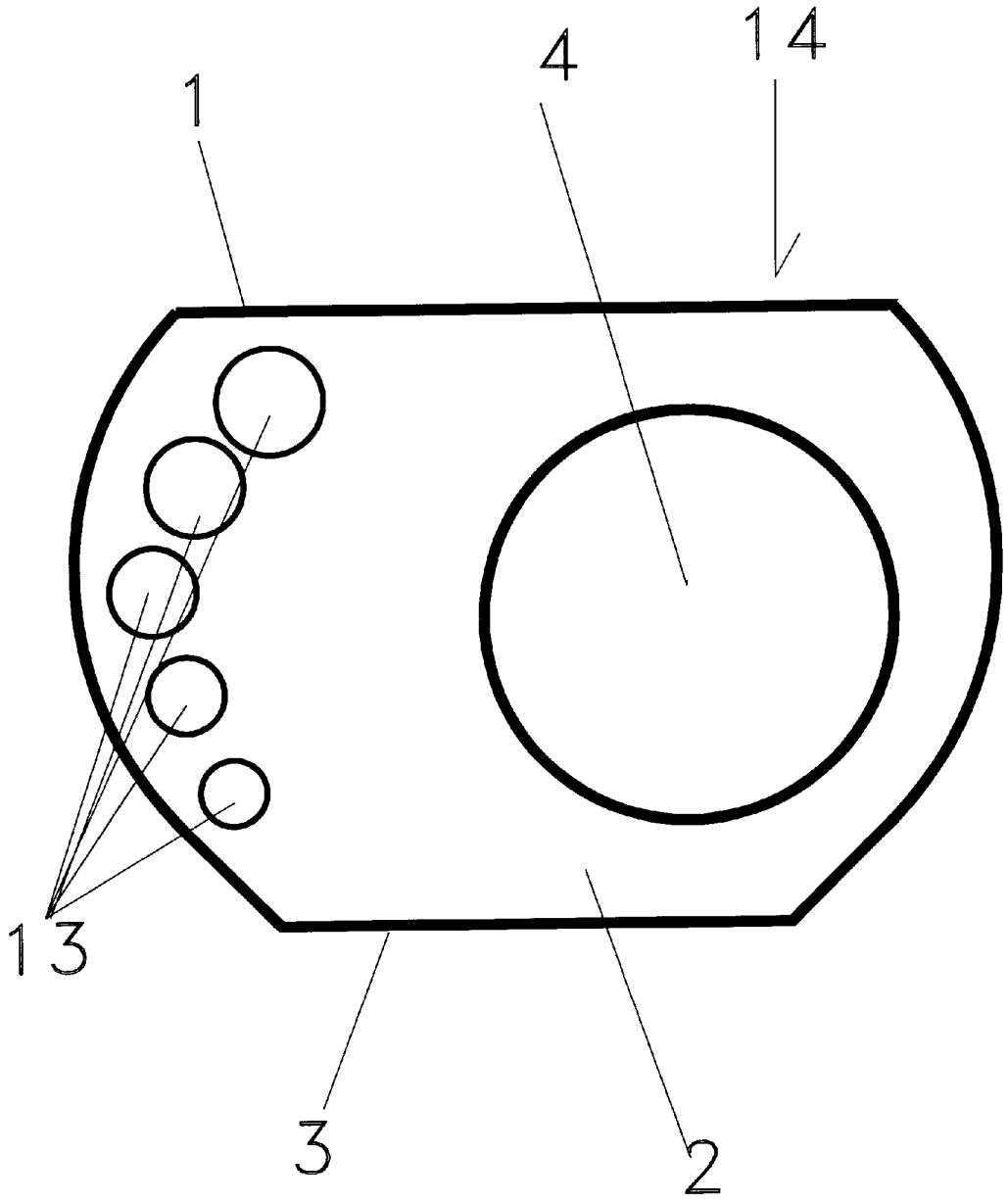
FIG. 9 is a plan view of one surface of an embodiment of the invention.

FIG. 9 shows another embodiment of the drum of this invention. Drum 14 comprises a set of playing means 13. In a preferred embodiment, the set of playing means 13 are air portals positioned to be played by a performer's fingers and playing means 4 is a drumhead. The performer plays the drumhead with one hand and the set of air portals with the other to vary the pitch of the drum.

Figure 10:
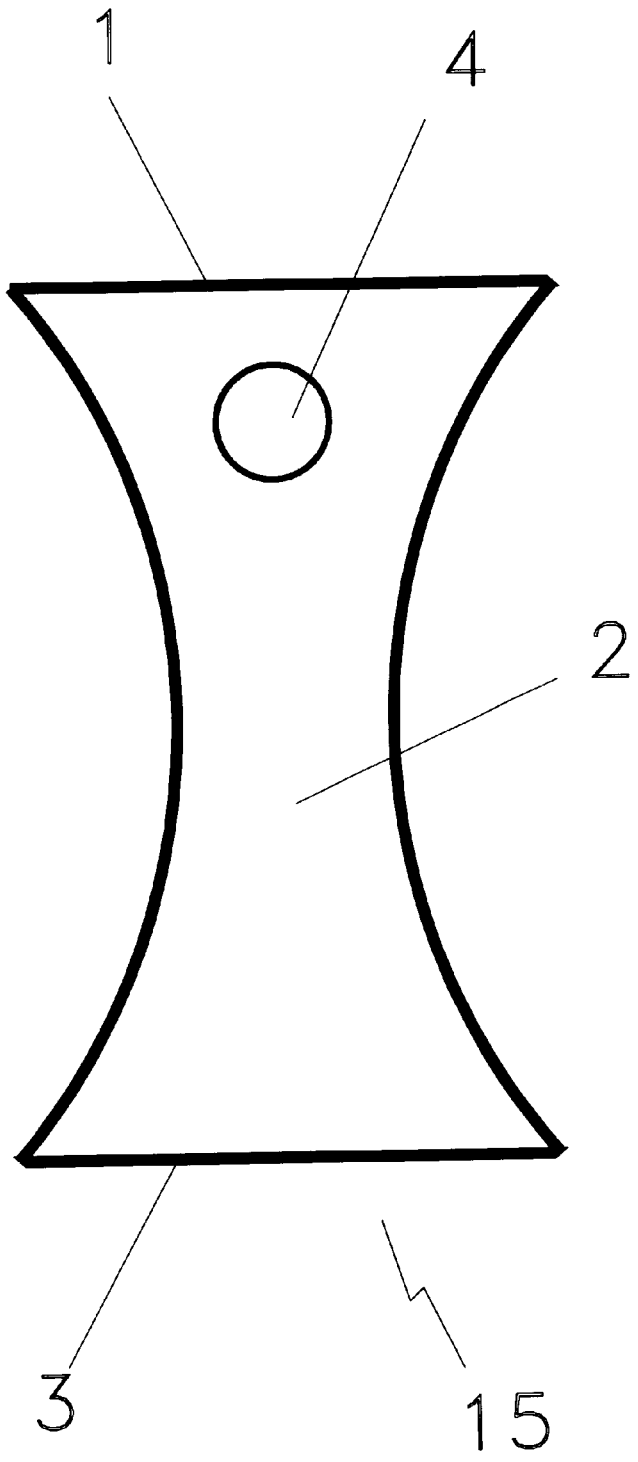
FIG. 10 is a plan view of one surface of an embodiment of the invention.

FIG. 10 shows the drum 15. When compared to the drum 6 in FIG. 3, the main difference is the shape of drum surface 2. The purpose of FIG. 10 is to illustrate that the exact shape of the drum is variable.

Figure 11:
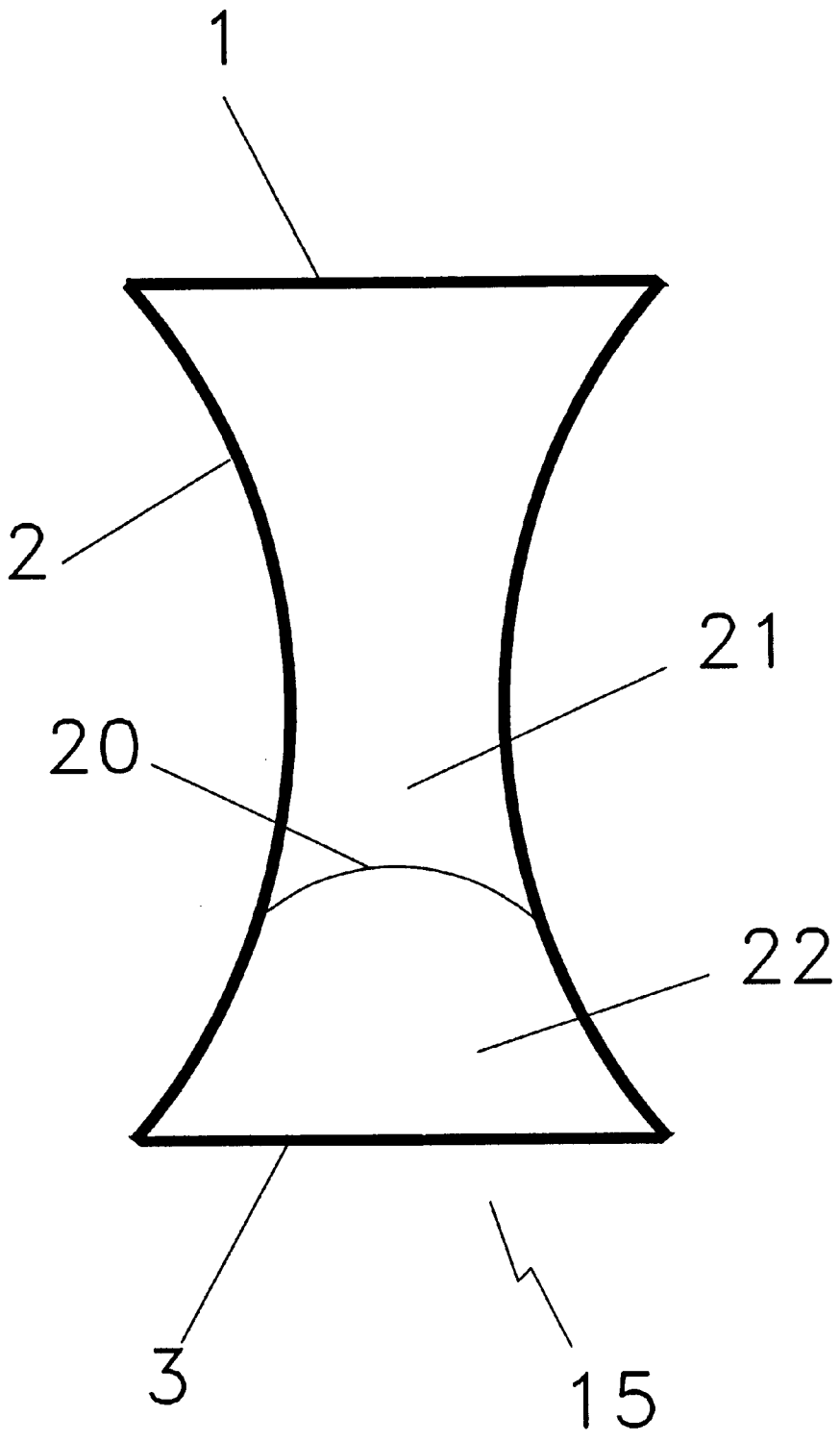
FIG. 11 is a cross section view of a dual chambered drum.

FIG. 11 illustrates the addition of partition 20 to the drum of FIG. 10. The inside of drum 15, or any other drum with a suitable shape, can thus be partitioned, into primary chamber 21 and auxiliary chamber 22. This partitioning of the drum permits further variation in pitch. That is, differences in the sizes of the primary and auxiliary chambers, as well as the use of different sizes of drum heads and air portals on, for example, surfaces 1 and 3, permit great variation in the pitch an experienced drummer or percussionist can attain. Furthermore, if the auxiliary chamber is completely enclosed and beads, pellets or the like are contained within the auxiliary chamber, the additional percussion effect of an integrated shaker is added to the drum. For example, a percussionist can simultaneously rotate the drum and play the drumhead to obtain a background swishing sound of the internal beads or pellets to augment the taps on the drumhead.

Figure 12:
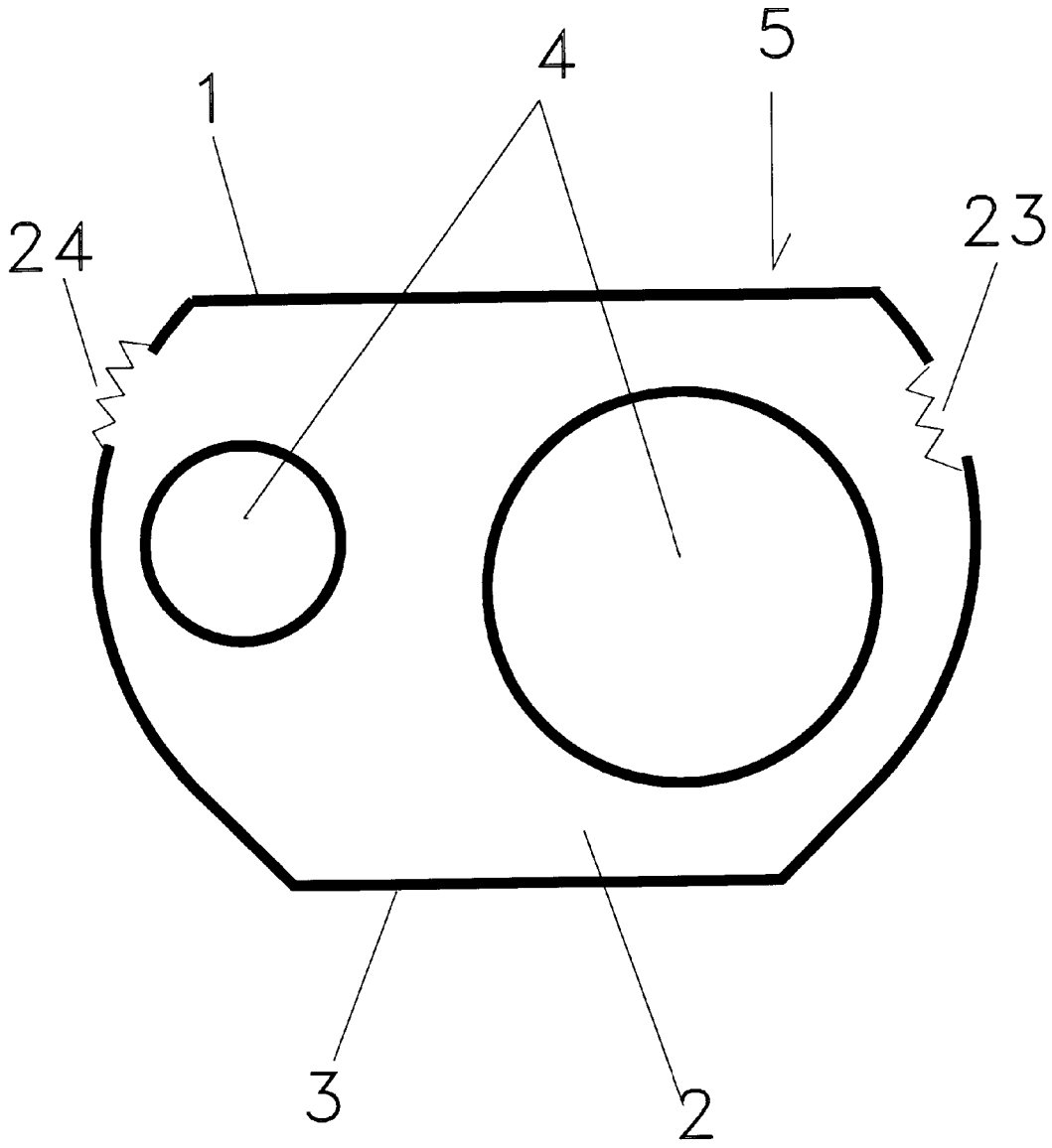
FIG. 12 illustrates the addition of other percussion features to the drums of this invention.

FIG. 12 illustrates a drum of this invention further comprising additional percussion means. The additional means illustrated are ridges 24 and indentations 23. The percussionist plays these to obtain a grating or scraping sound as needed. The addition of a support port, rod or clamp (not illustrated) permits the interchangeable use of further additional percussion means such as, for example, blocks, cymbals, bells, chimes, triangles, and rattles.

Figure 13:
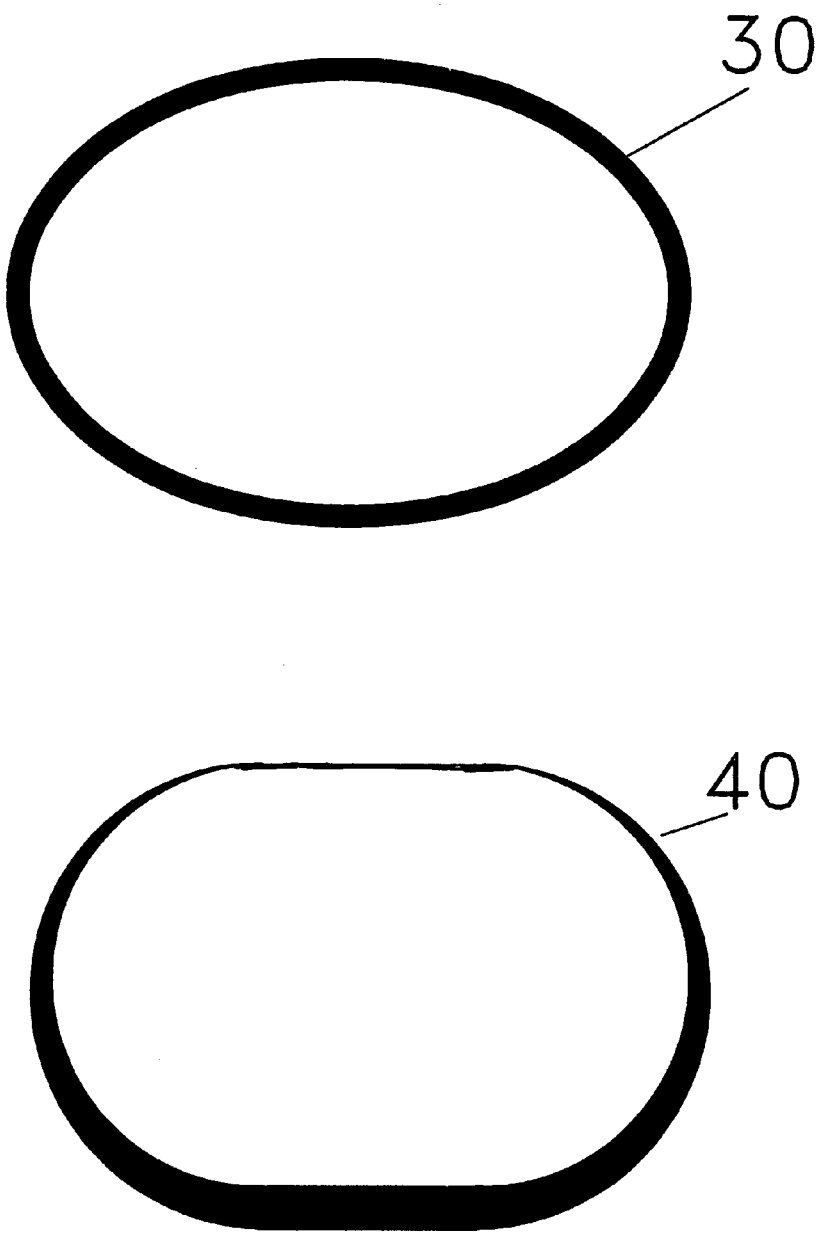
FIGS. 13 and 14 illustrate the use of variable wall thickness to vary pitch in the shakers of this invention.
Figure 14:
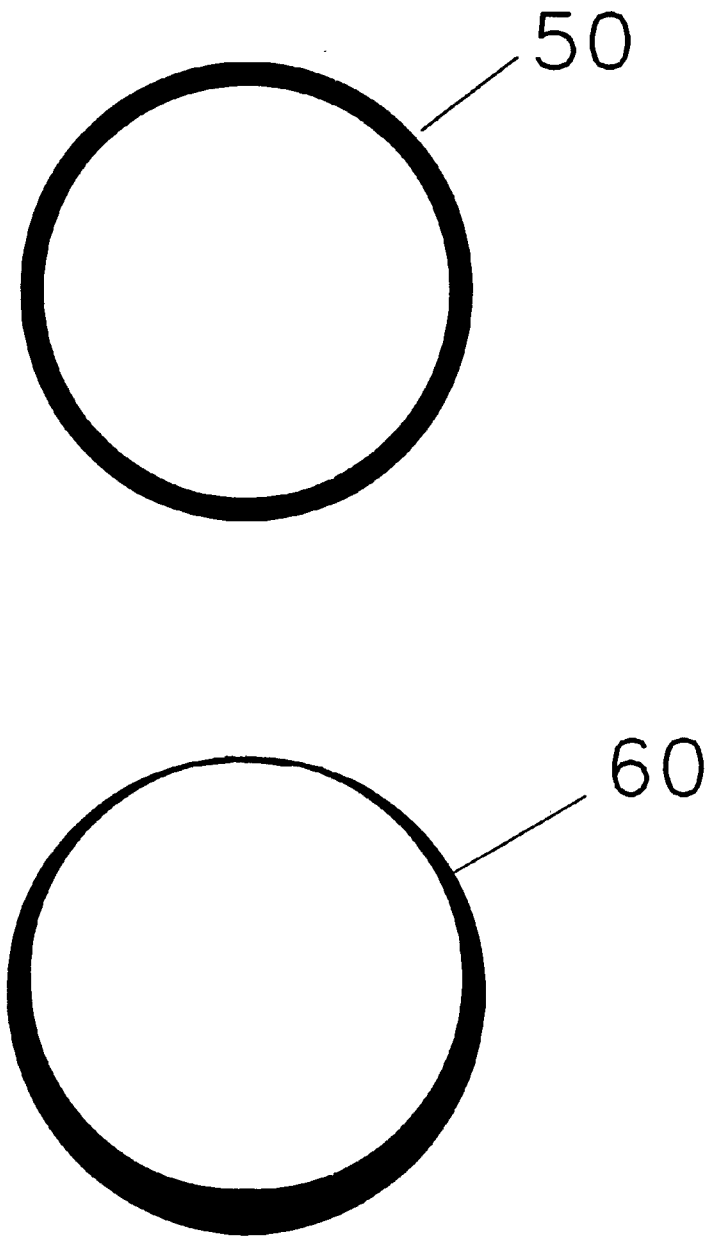

FIGS. 13 and 14 illustrate the method used to vary the pitch of a rattle or shaker. For orientation, the reader should refer to those figure during the following discussion. A typical egg shaped shaker 30 or spherical shaker 50 comprises a shell with near uniform thickness. Although there is a change in rhythm when one shakes the egg from pole to pole (side to side) rather than top to bottom, or front to back, there is little or no variation in pitch. To the contrary, if a portion of the shell of an egg shaker is thinner than or made of different material than the remainder of or other parts of the shell of that egg shaker a change in pitch can be achieved. As illustrated in the figures, the top portions of the shells of egg shaker 40 and spherical shaker 60 are thinner than the remainder of those shells. Shaking the egg shaker 40 or the spherical shaker 60 from front to back results in the same rhythm but a different pitch compared to shaking those shakers from top to bottom. Likewise, a variation in pitch can be achieved by replacing the thin tops of shakers 40 and 60 with material which is different from the remainder of those shakers. The applicant, first experimented with these concepts by introducing an egg shaker wherein a calf skin membrane was inserted in the position of the thin area of egg 40 and rice was inserted inside the egg. This yielded good but imperfect results, as both the natural skin and the rice grains tend to vary in consistency with temperature and humidity. Synthetic beads and membranes and the variation in shell thickness as previously described yield more consistent results over time. The shaker principles discussed are employed in the shaker drum described earlier. Referring back to FIG. 11, parts of the shell or walls of auxiliary chamber 22 may have different thickness or made of different material from other parts of the shell or wall of the auxiliary chamber. For example, partition 20 may be a flexible membrane whereas the other auxiliary chamber walls are rigid.

Figure 15:
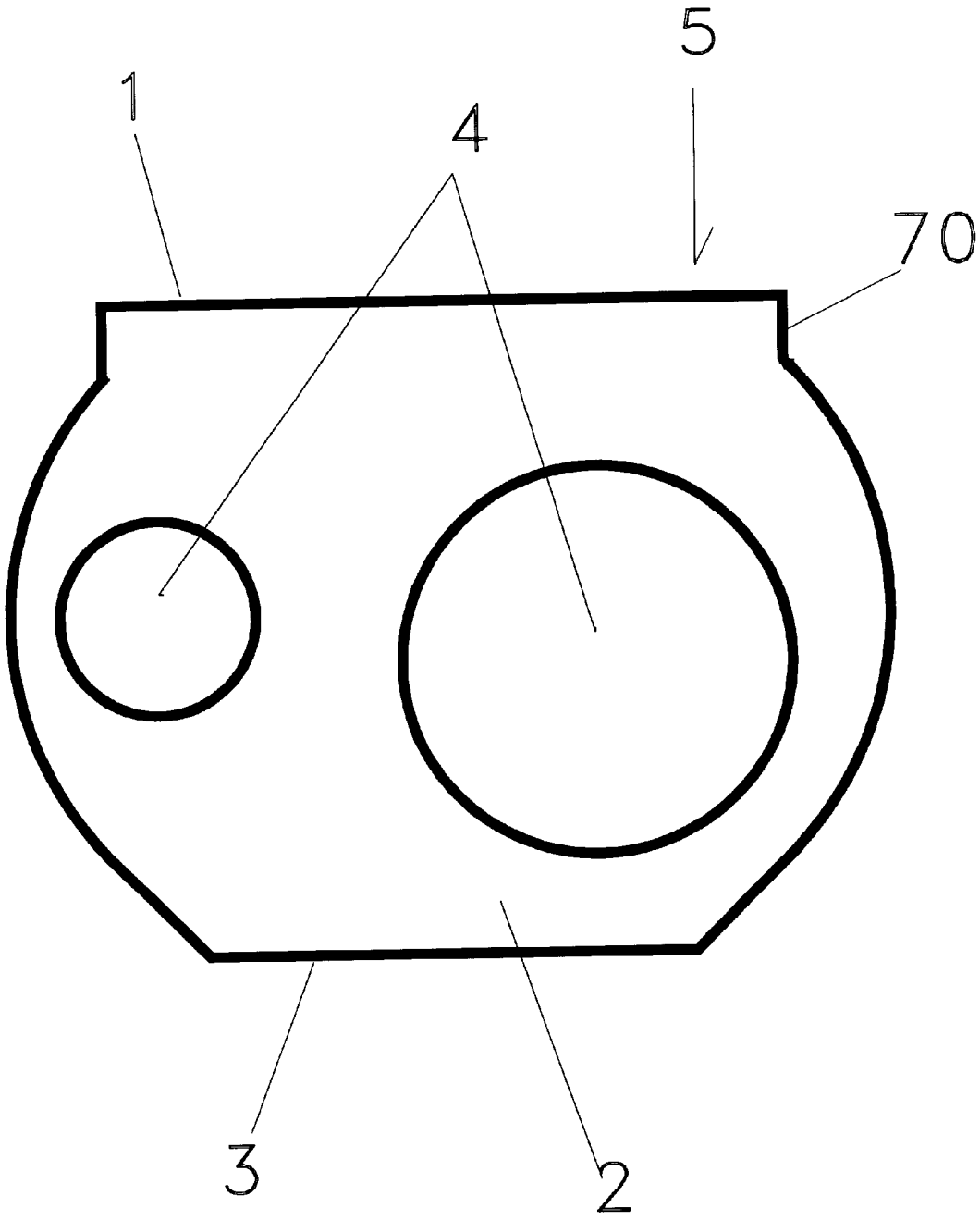
FIG. 15 illustrates the addition of design surfaces to the drums of this invention.

FIG. 15 illustrates that a surface 70, such as, for example, a ridge or bevel, can be inserted between two surfaces, for example, for design purposes, without changing the principles described herein. Thus, although it is preferable, that surfaces 1 and 2 be adjacent to each other it is not an absolute requirement.

Although preferred embodiments have been described and illustrated, the invention is not intended to be limited to the exact embodiments. The exact shape of the drum is variable and limited only by the imagination. The number and shape of the drum surfaces is limited only by the shape of a particular drum. A drum surface may comprise any number of playing means. Furthermore, the number of playing means is limited by the dimensions of the drum surfaces and the dimensions of the playing means employed. The scope of the invention is intended to be determined by the claims interpreted in light of the specification and the prior art.

I claim:

1. A variable pitch musical drum comprising drum surface 1, drum surface 2, and drum surface 3, wherein drum surface 2 is circumferentially attached to drum surface 1 and to drum surface 3, drum surface 1 comprises a drumhead playing means, drum surface 2 comprises a drumhead playing means and an air portal playing means, drum surface 3 is closed, the drumheads and the air portal are positioned to allow a player to alternately and rapidly play the drumheads with one hand while simultaneously varying the occlusion of the air portal with the other hand.

2. The drum of claim 1 wherein drum surface 1 and drum surface 2 are at approximately right angles to each other.

3. A variable pitch musical drum comprising drum surface 1, drum surface 2, and drum surface 3, wherein drum surface 2 is circumferentially attached to drum surface 1 and to drum surface 3, drum surface 1 comprises at least one drumhead playing means, drum surface 2 comprises at least one drumhead playing means and at least one air portal playing means, drum surface 3 is closed, the drumheads and each air portal are positioned to allow a player to alternately and rapidly play the drumheads with one hand, while simultaneously varying the occlusion of at least one air portal with the other hand.

4. The drum of claim 3 wherein drum surface 1 and drum surface 2 are at approximately right angles to each other.

5. A variable pitch musical drum comprising drum surface 1, drum surface 2, and drum surface 3, wherein drum surface 2 is circumferentially attached to drum surface 1 and to drum surface 3, drum surface 1 comprises at least one drumhead playing means, drum surface 2 comprises at least one air portal playing means, drum surface 3 is closed, each drumhead and each air portal is positioned to allow a player to play a drumhead with one hand, while simultaneously varying the occlusion of at least one air portal with the other hand.

6. The drum of claim 5 wherein drum surface 2 further comprises at least one drumhead, and each drumhead and each air portal is positioned to allow a player to alternately and rapidly play the drumheads with one hand, while simultaneously varying the occlusion of at least one air portal with the other hand.

7. The drum of claim 5 wherein drum surface 1 further comprises at least one air portal.

8. The drum of claim 5 wherein drum surface 1 and drum surface 2 are at approximately right angles to each other.

* * * * *